United States Patent [19]

Reinovsky

[11] Patent Number: 4,616,565

[45] Date of Patent: Oct. 14, 1986

[54] MODULAR DETONATOR DEVICE

[75] Inventor: Robert E. Reinovsky, Albuquerque, N. Mex.

[73] Assignee: The United States of America as represented by the Secretary of the Air Force, Washington, D.C.

[21] Appl. No.: 622,613

[22] Filed: Jun. 20, 1984

[51] Int. Cl.[4] ..... F42B 3/12; F42C 19/12

[52] U.S. Cl. ..... 102/202.7; 102/202.5; 102/202.9

[58] Field of Search ..... 102/202.7, 202.5, 202.9, 102/202.12, 202.14

[56] References Cited

U.S. PATENT DOCUMENTS

| | | | |
|---|---|---|---|
| 372,046 | 10/1887 | Stuart | 102/202.9 |
| 1,306,510 | 6/1919 | Allison | 102/202.5 |
| 2,419,371 | 4/1947 | Schlumberger | 102/322 |
| 2,696,191 | 12/1954 | Sheehan | 102/202.9 |
| 2,755,735 | 7/1956 | Harter, Jr. | 102/317 |
| 3,181,464 | 5/1965 | Parker et al. | 102/202.7 |
| 3,314,361 | 4/1967 | Olson et al. | 102/202.7 |
| 3,351,012 | 11/1967 | Wilson | 102/202.7 |
| 3,482,518 | 12/1969 | Sweetman | 102/202.14 |
| 3,926,119 | 12/1975 | Hurst et al. | 102/315 |

*Primary Examiner*—Charles T. Jordan

*Attorney, Agent, or Firm*—Donald J. Singer; Jules J. Morris; James E. Maslow

[57] ABSTRACT

Modular detonator device for use in series array line detonations. The detonator device comprises a case, a coupler and a base. A first electrical contact is disposed on the base and is coupled through an exploding bridge-wire and the coupler to the case, where the external wall of the case comprises a second electrical contact of the device. The device may be battery-like in external configuration to facilitate end-to-end placement of a multiplicity of the device in a practically infinite series array, with external wiring necessarily being connected only to the lead and the trailing end of such series array.

19 Claims, 7 Drawing Figures

MODULAR DETONATOR DEVICE

STATEMENT OF GOVERNMENT INTEREST

The invention described herein may be manufactured and used by or for the Government for governmental purposes without the payment of any royalty thereon.

BACKGROUND OF THE INVENTION

The present invention relates to exploding bridgewire ordnance, and more particulary, to a packaging technique for exploding bridgewire devices which allows custom field assembly of line detonations.

Exploding bridgewire devices have been known for many years in explosive applications. In U.S. Pat. No. 2,755,735 and U.S. Pat. No. 3,351,012, various explosive cartridge assemblies are disclosed which demonstrate two varieties of known packaging of such devices. The former patent is directed to use with a blasting cap, while the latter patent specifically relates to exploding bridgewire initiators. In the latter patent a header contains lead wires to be electrically connected to a high voltage initiator circuit. A known alternative means of such electrical connection is use of a coaxial connector which can be mated with and fastened to the initiator package.

One problem with these known arrangements, particularly when a plurality of such devices must be used in a given application, is that electrical wire must be run to each individual package. This requires extra work space, extra work time, and extra materials. Furthermore, such known electrical interconnection is known to fail, as a result of physical damage in handling, defective construction, and the like.

Furthermore, while a wide variety of high explosive initiation systems are available, a simultaneous, axially symmetric line initiator system is not available. As well, any such line initiator system is preferrably one that requires a minimum of field assembly.

SUMMARY OF THE INVENTION

It is therefore an object of the present invention to obviate the abovestated deficiencies in a new package design for explosive bridgewire devices.

It is a further object of the present invention to provide a packaging arrangement which enables virtually infinite series connection of modular explosive units with a minimum of external wiring, which can be detonated from a single power source.

The present invention comprises an individual detonator device, having a leading and a trailing electrical contact defined on the detonator package exterior, wherein a series of such devices can be assembled end-to-end to produce a long line of simultaneously detonatable devices. Each individual detonator device incorporates a high explosive pellet and an exploding bridgewire, with an initial package of low explosive material thereinbetween. The bridgewire is internally coupled to the leading and trailing electrical contacts on the detonator package exterior. Thus, where series line detonation is contemplated, an entire assembly of such devices mated end-to-end may be triggered by a single source of electricity with a minimum of external electrical connections being required therefor.

DESCRIPTION OF THE DRAWINGS

The invention will be more clearly understood by reference to the following detailed description of a preferred embodiment thereof in conjunction with the accompanying drawings, in which.

DETAILED DESCRIPTION

Figure 1:
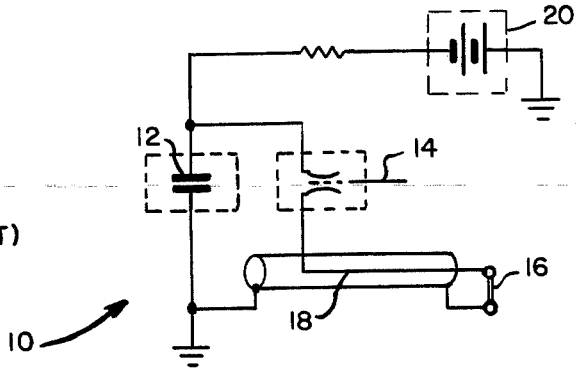
FIG. 1 (PRIOR ART)
FIG. 1 is a typical exploding bridgewire firing circuit.

The basic electrical firing circuit for an exploding bridgewire device is illustrated in FIG. 1. In the illustration of FIG. 1, a conventional prior art firing circuit 10 comprises a grounded power source 20 resistively coupled to a first side of the parallel combination of capacitor 12 and triggered spark gap 14. In turn, the remaining leg of capacitor 12 is coupled to ground and to one leg of bridgewire 16, while the other leg of triggered spark gap 14 is coupled via transmission line 18 to the remaining leg of bridgewire 16 to complete the firing circuit.

When firing circuit 10 is triggered, voltage is applied to the transmission line 18 and bridgewire 16 which causes current to start to flow at a rate controlled by the RLC of the circuit, representing an increasing current value from zero. This rate of current flow (approximately 1000 amperes per microsecond) and the amount of energy, is so great that the wire is heated to vaporization but the physical shape of the wire is maintained by inertia. When vaporization ocours, the resistance of the wire greatly increases. At this point the current reduces at approximately one microsecond. Within a few nanoseconds after vaporization, the inertia of the wire material is overcome and the wire explodes giving off a shock wave and the contained thermal energy. After a few nanoseconds, ionizaton occurs and current increases due to the low resistance of the ionized gas remaining.

Figure 2:
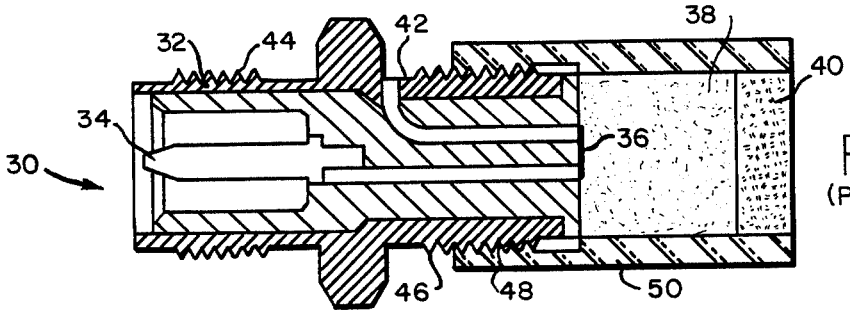
FIG. 2 (PRIOR ART)
FIG. 2 is a typical known exploding bridgewire detonator package configuration.

Referring now to FIG. 2, the configuration of an illustrative prior art detonator device is shown. In the configuration of FIG. 2, detonator device 30 comprises a molded header 32, wherein bridgewire 36 is electrically connected between electrically conductive casing 42 and electrically conductive pin 34. Pin 34 mates with a corresponding coaxial plug (not shown), which plug is fastened to detonator 30 by means of threads 44.

Detonator 30 further comprises sleeve 50, with an initiating explosive 38 and a high density explosive pellet 40 packaged therein. Header 32 is threadedly mated with sleeve 50 by means of cooperating threads 46, 48, respectively, as shown, such that bridgewire 36 is brought into close proximity with initiating explosive 38.

Figure 3:
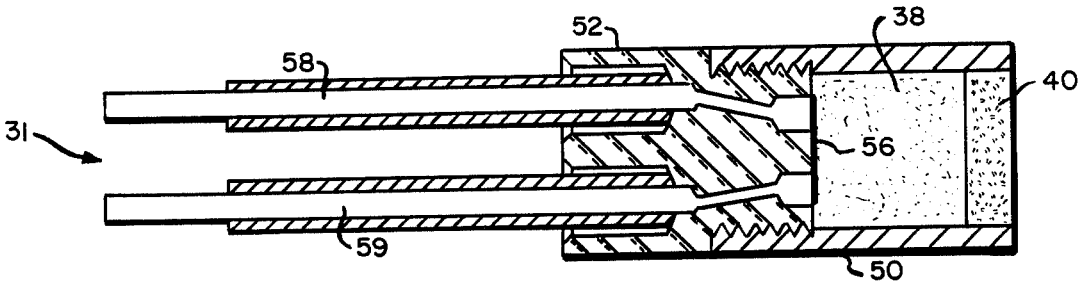
FIG. 3 (PRIOR ART)
FIG. 3 is a known alternative embodiment of the device of FIG. 2.

FIG. 2 thus discloses a coaxial configuration of a known detonator device. A known alternative embodiment to such coaxial connection, comprising a pigtail means of electrical connection, is shown in FIG. 3. In the embodiment of FIG. 3, detonator device 31 comprises molded header 52, within which one leg of bridgewire 56 is electrically coupled to a first pigtail lead 58 and is coupled at its other leg to a second pigtail lead 59. Header 52 is threadedly coupled to the same earlier described sleeve 50 in the manner as earlier described. This pigtail connection may also be replaced by a multipin arrangement also known in the art, but not described in detail herein. Nevertheless, in each of these known arrangements, individual cabling is laid from the power source to each detonator device and is coupled thereto by coaxial pigtail or multipin connectors, or the like.

Figure 4:
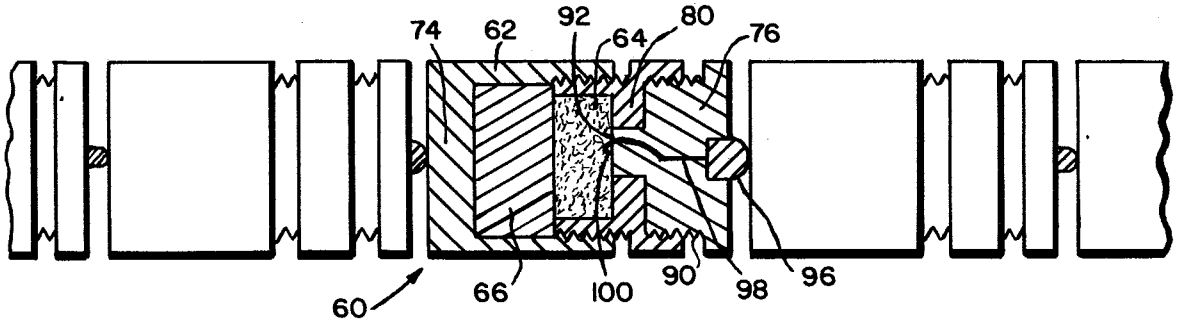
FIG. 4 shows a series of modular detonator devices in practice of the present invention, where one device is shown in side cross-section.

Referring now to FIG. 4, a series of modular detonator packages in practice of the present invention is shown, where one modular detonator device 60 is shown in side cross-section. In the embodiment of FIG. 4, modular detonator device 60 comprises case 62, coupler 80 and base 76, as more particularly described below. In a preferred embodiment of the present invention, detonator device 60 can be externally configured in the nature of a dry-cell flashlight battery, having leading and trailing electrical contracts, as more particularly described below.

Figure 5:
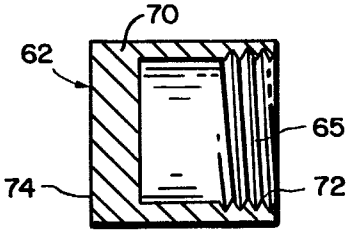
FIG. 5 is a side cross-sectional view of case 62 of the embodiment of FIG. 4.

Referring now to FIG. 5, it will be seen that case 62 of modular detonator device 60 comprises a shell 70 having a terminating wall 74, as shown. Wall 74 and shell 70 are electrically conductive thereinbetween, and the outer surface of wall 74 acts as a trailing electrical contact, as will be further discussed hereinbelow. Case 62 houses a high density pellet 66, as seen in FIG. 4, which is placed adjacent to the interior side of wall 74. Case 62 also defines an internally threaded opening 65 at one end thereof having internal threads 72 thereat.

Figure 6:
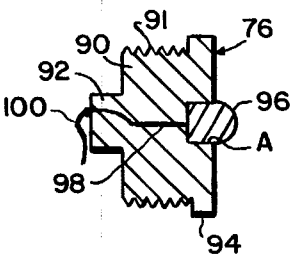
FIG. 6 is a side cross-sectional view of base 76 of the embodiment of FIG. 4.

Referring now to FIG. 6, base 76 is shown comprising a body section 90 having external threads 91. Body section 90 also comprises a center projection 92 defined at a terminus thereof. At its other terminus, base 76 comprises a flange 94 defining a recess A therein. As seen in FIG. 6, a leading electrical contact 96 is affixed to base 76 at recess A, where an electrical lead-in wire 98, connected to contact 96, is brought through base 76 to the terminus of projection 92, where wire 98 is connected to one leg of bridgewire 100. Base 76 preferrably is comprised of an electrically non-conductive material, or is otherwise rendered functionally non-conductive.

Figure 7:
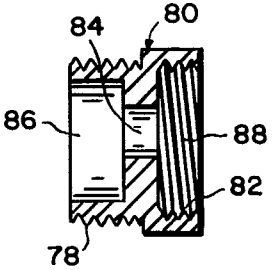
FIG. 7 is a side cross-sectional view of coupler 80 of the embodiment of FIG. 4.

Referring now to FIG. 7, coupler 80 is shown having recesses 86, 88 defined therein, with external threads 78 and internal threads 82, respectively, as shown. Recesses 86 and 88 are communicated thereinbetween by means of through-hole 84 defined within coupler 80. Coupler 80 preferably is comprised of electrically conductive material as will be further discussed below.

In application of the present invention, base 76 mates with coupler 80 whereby the threaded body section 90 of base 76 is mated with recess 88 of coupler 80 and whereby projection 92 of base 76 projects into through-hole 84 of coupler 80. During this mating process, in a preferred embodiment, bridgewire 100, being attached at one leg thereof to projection 92 as described earlier, is also projected into through-hole 84, where the unconnected leg of bridgewire 100 is caused to extend into recess 86 defined within coupler 80. After such mating, bridgewire 100 is deformed or otherwise folded over within recess 86 to make electrical contact with the nearby internal electrically conductive surface of coupler 80. This leg of bridgewire 100 may be soldered to the interior surface of coupler 80, if desired, while frictional coupling may be suitable for various applications of the present invention.

After connection of wire 100 to coupler 80, as aforesaid, a low density explosive material is poured into the cup-like recess 86, and is tamped therein to presecribed packaging requirements for such explosive material. This so-called loaded assembly, now comprising base 76, coupler 80, bridgewire 100, and secondary explosive 64, is ready to be mated with case 62. First, however, a high density explosive pellet 66 is inserted into case 62. Now the aforesaid so-called loaded assembly is coupled to case 62 by means of externally threaded coupler 80 cooperating with the internally threaded recess 65 of case 62. Thus high density pellet 66 is held between the interior of end wall 74 and the inserted and loaded recessed end of coupler 80, as shown in FIG. 4. Therefore, by means of this coupling, bridgewire 100 is brought into close proximity with low density explosive 64, which in turn is brought in contact with high density explosive pellet 66, so as to facilitate explosive interaction thereinbetween.

In practice of the above disclosed configuration, the electrical firing circuit thereof comprises the electrical connection of contact 96, coupled by lead-in wire 98 to one leg of bridgewire 100, and through bridgewire 100 and electrically conductive coupler 80 to end wall 74 of coupler 80. This internal firing circuit is then externally completed by means of connection of a high voltage power source to contact 96 and to the outer surface of end wall 74. In this manner, the conventional firing circuit of FIG. 1 may be novelly achieved in practice of the present invention.

Furthermore, it will now be appreciated that a multiplicity of explosive devices in practice of the present invention may be placed in end-to-end series abutment, in the nature of a series of flashlight batteries, such that only a single pair of wires need be run, one wire to the leading and one wire to the trailing terminal of this series array to effect complete wiring thereof. It should be noted, however, that unlike a flashlight battery, the present device is bi-directional, such that in a series array, any end-to-end configuration will be fully functional in practice of the present invention.

It will be understood by those of ordinary skill in the art that a conventional, single element exploding bridgewire device is initiated by an electrical pulse of 1–2 microsecond or an average dI/dT of $10^9$. The bridgewire is typically comprised of gold, having a 0.001 inch diameter and 0.030 inch length. The volume of the wire is typically about $3.9\times10^{-7}$ cc, and the mass is typically $7.3\times10^{-6}$ gr. The wire requires less than 0.1 joule to vaporize. Delivering 0.1 joule in one microsecond requires a power of $10^5$ watts or 100 volts at one kiloamp. Following vaporization, the confined metal vapor exhibits high resistance. A crude estimate of metal vapor resistance is $10^{-3}$ ohms/cm (a value displayed by a wide variety of elements). Hence, the resistance of the vaporized wire is approximated at 10 to 20 ohms.

Conventional explosive bridgewire philosophy requires that the wire not only vaporize but also that it be driven rapidly into plasma state to generate higher pressure. Confined metal vapor exhibits relatively high dielectric strength which is typically greater than 10 KV/cm under optimum conditions. Thus to ensure breakdown, electric fields of 50 to 100 KV/cm should be applied—or 5 to 10 KV along a 0.030 inch long wire. Assuming that external circuit inductance is high enough that the one kiloamp of current is roughly maintained as is the case in conventional explosive bridgewire devices during vaporization, the voltage produced across the wire should be roughly one kiloamp at 15 ohms or 15 kilovolts to achieve breakdown. To maintain the current near one kiloamp requires an inductance large enough such that $L/R=0.1$ microsecond. Thus, where a wire of 15 ohms is employed, inductance should be measured at approximately 1.5 microhenries. For comparison, a 1.5 microhenry inductance represents about 20′ of conventional detonator cable and stores almost one joule of energy when charged with one kiloamp of current (compared with less than 0.1 J to vaporize one wire). A conventional firing set operates at three kilovolts and would produce a current of one to two billion amps per second (one to two kiloamps per microsecond) when applied to the 1.5 microhenry inductance, which is consistent with the parameters noted above.

In view of the above, the circuit required for the simultaneous initiation of a series of detonations in practice of the present invention can thus be described. Taking 20 detonators, for example, would suggest a need to charge a 30 microhenry inductance to one kiloamp in about one microsecond. The voltage required would be 30 kilovolts, where $V=L\ dI/dT$. The total energy would be 15 to 50 joules. A simple 0.1 microfarad capacitor charged at 30 KV would store 45 joules and be quite adequate. A conventional high voltage spark gap could be employed to discharge the capacitor, and a conventional high voltage coaxial cable could be used to deliver the initiator pulse to the series array. While somewhat lower voltage triggering schemes can be developed, this analysis shows that at least one known approach can be identified to adequately initiate a series arrangement of modular detonators in practice of the present invention.

It will be appreciated that while threaded interconnection of case 62, coupler 80 and base 76 has been discussed, frictional forced fit or other mating means are within the spirit and scope of the present invention, and, furthermore, that end wall 74 of case 62 can be deformed outward to better define the surface thereat or may comprise a flanged arrangement to create an open-ended explosive device, where contact 96 is cooperatively off-set from the center of base 76 so as to be able to mate with any such flanged case in a given series array.

Thus, while the present invention has been described in connection with a rather specific preferred embodiment thereof, it will be understood that many modifications and variations will be readily apparent to those of ordinary skill in the art and that this application is intended to cover any adaptation or variation thereof. Therefore, it is manifestly intended that this invention be only limited by the claims and the equivalents thereof.

What is claimed is:

1. A detonator module, comprising:

a case having an outer terminus, for housing an explosive pellet;

a base having an outer terminus, for housing an explosive bridgewire;

a coupler for retaining an explosive charge in close proximity to said explosive bridgewire and to said explosive pellet; and a means for completing an electrical path from said outer terminus of said case to said outer terminus of said base through said coupler and said bridgewire in a manner which allows use of said detonator module in a series of detonator modules.

2. The module of claim 1 wherein said coupler defines a first recess, a through-hole, and a second recess, said through-hole communicating between said first and said second recess; and said base defines a projection, one leg of said bridgewire coupled to said projection, said projection cooperating with said first recess of said coupler to deliver said bridgewire through said through-hole to said second recess of said coupler.

3. The module of claim 2, wherein said second recess of said coupler comprises a cup-like apparatus for receipt of an explosive charge.

4. The module of claim 3, wherein said base is electrically non-conductive.

5. The module of claim 4, wherein said outer terminus of said base further defines an electric contact receiving recess.

6. The module of claim 5, further comprising an electric contact affixed to said base at said electric contact receiving recess, said electric contact electrically coupled through said base to said bridgewire.

7. The module of claim 3, wherein said case and coupler are electrically conductive.

8. The module of claim 3, wherein said case defines a pellet-receiving recess.

9. The module of claim 6, wherein said outer terminus of said case comprises an electrically conductive outer wall.

10. The module of claim 6, wherein said outer terminus of said case comprises at least one electrically conductive flange, said flange defining a cavity in said case.

11. The module of claim 1, wherein said case, base and coupler mate to form a closed end cylindrical module.

12. A detonator device for use in series line detonations comprising a detonator body shaped for pressure electrical contact with another body at opposing ends, in which said detonator body comprises:

(a) a case having an electrically conducting shell and a recess for receiving an explosive pellet;

(b) a coupler rotatably secured to said case, said coupler having a recess for receiving explosive material and being electrically conductive;

(c) a base of insulating material rotatably secured to said coupler having a recess in which is secured an electrically conducting contact wherein a lead-in wire connected to said contact passes through said base; and (d) a bridgewire connected to said lead-in wire and to said coupler wherein said bridgewire is adjacent to explosive material and capable of igniting said material when exposed to an electric current.

13. A modular detonator device, comprising:

an explosive bridgewire;

a cylindrical base having a terminus with a substantially flat first electric contact;

a cylindrical case defining a substantially flat second electric contact; and a cylindrical coupler disposed for coupling with said explosive bridgewire, said case and said base and for completing an electrical path between a first and a second electrical contact through said explosive bridgewire in a manner which allows series electrical contact by end abutment of adjacent modular detonators in a series of moldular detonators.

14. The device of claim 13, wherein:

said coupler defines a first and second recess and a through-hole, said through-hole communicating between said first and second recess; and said base defines a projection, said explosive bridgewire coupled to said projection, said projection aligned with said first recess of said coupler in order to direct said bridgewire through said through-hole to said second recess of said coupler.

15. The device of claim 14, wherein said second recess of said coupler comprises a cup-like configuration for receipt of an explosive charge, and wherein said case further defines a pellet-receiving recess.

16. The device of claim 15, wherein said first electrical contact is affixed to said base at said terminus and is electrically coupled through said base to one leg of said bridgewire.

17. The device of claim 13, wherein said case and said coupler are electrically conductive and said base is electrically non-conductive, and wherein an exterior wall of said case comprises said second electrical contact.

18. The device of claim 13, wherein said case is open-ended and has flanges defining a cavity thereinbetween.

19. The device of claim 17, wherein said case, coupler and base mate to form a cylindrical device having electrical contacts at each end.

* * * * *